US006893211B1

(12) United States Patent
Eibl et al.

(10) Patent No.: US 6,893,211 B1
(45) Date of Patent: May 17, 2005

(54) LIGHTWEIGHT STRUCTURAL COMPONENT HAVING A SANDWICH STRUCTURE

(75) Inventors: Helmut Eibl, Fürstenfeldbruck-Puch (DE); Erich Steinhardt, München (DE)

(73) Assignee: MIU Aero Engines GmbH, Munich (DE)

( * ) Notice: Subject to any disclaimer, the term of this patent is extended or adjusted under 35 U.S.C. 154(b) by 0 days.

(21) Appl. No.: 10/148,036

(22) PCT Filed: Nov. 20, 2000

(86) PCT No.: PCT/DE00/04091

§ 371 (c)(1),
(2), (4) Date: Aug. 15, 2002

(87) PCT Pub. No.: WO01/38698

PCT Pub. Date: May 31, 2001

(30) Foreign Application Priority Data

Nov. 24, 1999 (DE) ..... 199 56 444

(51) Int. Cl.[7] ..... F01D 25/04

(52) U.S. Cl. ..... 415/119; 415/200; 416/229 A; 416/230; 416/224; 416/500

(58) Field of Search ..... 415/119, 200; 416/229 R, 229 A, 230, 223 A, 224, 500

(56) References Cited

U.S. PATENT DOCUMENTS

| | | | | |
|---|---|---|---|---|
| 2,642,263 A | * | 6/1953 | Thorp, II | 416/233 |
| 2,750,147 A | | 6/1956 | Smith | |
| 2,921,769 A | | 1/1960 | Flader | |
| 3,566,493 A | * | 3/1971 | Poucher et al. | 29/889.71 |
| 4,395,196 A | * | 7/1983 | Plautz | 415/174 |
| 4,440,834 A | | 4/1984 | Aubert et al. | |
| 4,547,122 A | * | 10/1985 | Leech | 415/9 |
| 4,772,450 A | | 9/1988 | Friedman | |
| 5,498,137 A | | 3/1996 | El-Aini et al. | |
| 5,605,441 A | * | 2/1997 | Boszor et al. | 415/200 |
| 5,634,189 A | | 5/1997 | Rossmann et al. | |

FOREIGN PATENT DOCUMENTS

| | | |
|---|---|---|
| DE | 1 112 350 | 8/1961 |
| DE | 40 41 104 | 6/1992 |
| EP | 0 556 047 | 8/1993 |
| GB | 716612 | 10/1954 |
| GB | 757502 | 9/1956 |

* cited by examiner

*Primary Examiner*—Ninh H. Nguyen
(74) *Attorney, Agent, or Firm*—Kenyon & Kenyon

(57) ABSTRACT

A lightweight, composite structural element for turbo engines, includes a thin metallic shell and a metallic core structure, of which a large proportion of the volume is empty space, the shell and the core structure being rigidly connected to each other. The core structure has a spatial, felt-like and/or mesh-like construction and is made of one or more wires, strips, shavings, or comparable elements. The core structure is sintered together, and sintered to the shell.

8 Claims, 1 Drawing Sheet

LIGHTWEIGHT STRUCTURAL COMPONENT HAVING A SANDWICH STRUCTURE

FIELD OF THE INVENTION

The present invention relates to a lightweight, composite structural element for turbo engines having a thin, metallic wall layer or shell and a metallic core structure, of which a large proportion is empty space.

BACKGROUND INFORMATION

Many designs for lightweight composite structural elements having a thin outer shell and a light core structure are known for both metal and plastic constructions. A large part of the mechanical loads is absorbed by the shell. The primary function of the core structure is to support the shell, and it protects the shell from denting, buckling, etc. Rigid foams and honeycomb geometries are used as core structures, which are mechanically fixed to the shell, often by bonding. Depending on the type and direction of the structural-element loading, rib-like, spar-like, and stringer-like core structures are also used, particularly in the case of a pure metallic construction.

German Published Patent Application No. 40 41 104 describes a blade for turbo engines, which is of a lightweight construction and includes a blade shell and a blade core, the latter being made of a bundle of tubes that are rigidly connected to each other and the outer shell.

The mentioned methods of construction are indeed distinguished by light weight and high flexural stiffness, but their inherent damping in the case of dynamic loading/excitation is, as a rule, low. Blades and structures in turbo engines are subjected to high dynamic loads. Therefore, a high degree of inherent damping of the structural element is advantageous and determines its service life, especially in the case of unavoidable resonance states.

Therefore, it is an object of the present invention to provide a lightweight composite part for turbo engines, which has a low structural weight, high structural stiffness, and a high degree of inherent damping, and is therefore suitable for high dynamic loads.

SUMMARY

In accordance with the present invention, the desired, optimum combination of rigidity and inherent damping in conjunction with lightweight construction may be achieved by the configuration of the core structure, as well as by the manner in which it is internally consolidated or solidified and connected to the shell. The core structure may have a spatial, felt-like and/or mesh-like construction made of wires (also continuous wire), strips, shavings, etc., the desired damping essentially being attained by internal friction, i.e., the metal elements rubbing against each other. The necessary dimensional stability and stiffness of the core structure and the entire structure is achieved by sintering the metallic elements (wires, etc.) forming the core structure, to each other and to the shell. In the present case, the term "sinter" has nothing to do with powder metallurgy, but rather refers to surface welding, i.e., integrally connecting metallic elements in contact with each other, using heat and a certain pressure.

Thus, an exemplary embodiment of the present invention is to a lightweight, composite structural element for a turbo engine, including: a thin metallic shell delimiting the structural element on at least two sides opposite to one another and covering a large portion of a surface of the structural element; and a metallic core structure having a large proportion of empty space, the core structure including a cohesive structural element having at least one of a felt and mesh construction and including at least one of wires, strips and shavings, the core structure sintered together and sintered to the shell by surface welding, in which the shell and the core structure are rigidly joined to each other and are formed of one of a same metal and two metals having a same base.

Another exemplary embodiment of the present invention provides that the shell and the core structure are formed of a metal having one of an aluminum base, a titanium base, an iron base, a nickel base and a cobalt base.

The present invention is described below in detail, in light of the drawings, which schematically illustrate the present invention not to scale.

DETAILED DESCRIPTION

Figure 1:
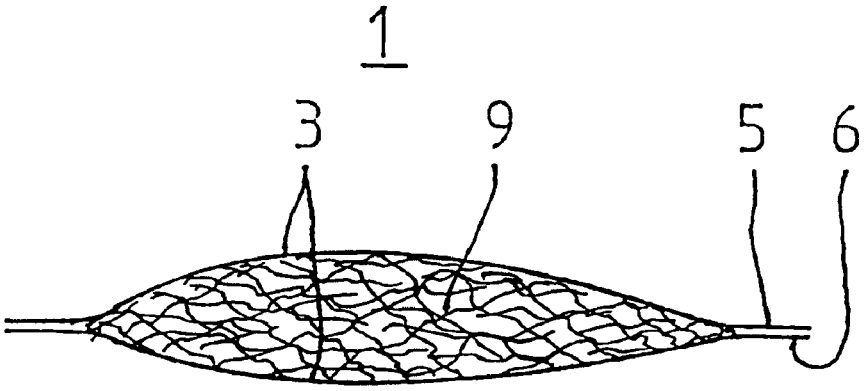
FIG. 1 illustrates a lightweight structural element in the form of a blade, in the prefabricated state.
Figure 2:
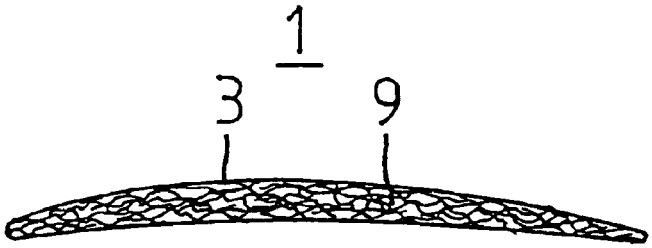
FIG. 2 illustrates the blade illustrated in FIG. 1, in the finished state.

FIGS. 1 and 2 illustrate two manufacturing stages of a blade 1 of lightweight construction for a turbo engine, for example, a compressor blade for a gas turbine engine. As illustrated, the blade includes a thin shell 3, which is made of metal and covers the structural element, as well as a felt-like or mesh-like core structure 9 that is also made of metal. As illustrated in FIG. 1, shell 3 is made up of two curved or convex cover sheets 5, 6. As an alternative, a comparably formed, one-piece, thin-walled hollow section may be used. As illustrated in FIG. 1, core structure 9 is preformed, but not yet solidified in itself and also not yet integrally connected to shell 3. The transition from the processing state illustrated in FIG. 1 to the state illustrated in FIG. 2 includes several steps.

Cover sheets 5, 6 are integrally connected in the region of the leading and trailing edges of the blade section, e.g., using welding or soldering. The molded article made of shell 3 and enclosed core structure 9 is brought into the desired blade profile by compression, using a suitable tool and a press, and is sintered, i.e., heated under pressure until the compressed core-structure elements (wires, shavings, strips, etc.) are integrally connected to each other on the surface, and integrally connected to shell 3 on the surface (sintering). This solidifies the blade, and it retains its shape, even after being removed from the press tool. A certain elastic recovery/decompression of the blade section may be compensated for by compressing the profile in the mold to the point of being undersized (reducing the profile thickness below the nominal thickness), so that it has the desired contour after elastically recovering.

The leading and trailing edges of the blade section may have to be machined, in order to either remove protruding ends of cover sheets 5, 6 or attain the specified edge radii.

The finished section of blade 1 is illustrated in FIG. 2, which corresponds to an axial section of the structural element. Lightweight composite blades may also have solid regions, e.g., the base of the blade and a cover band. In the light method of construction according to the present invention, it may be best to manufacture the solid zones of the structural element as separate sections and subsequently integrate them into the actual lightweight composite, using welding, soldering, bonding, etc.

Figure 3:
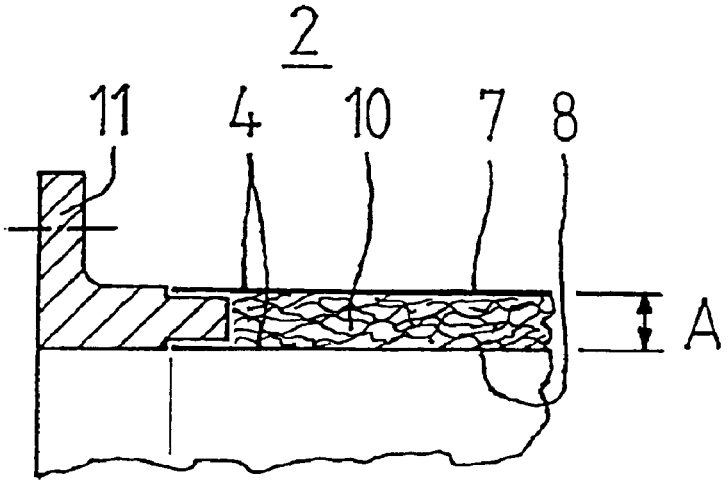
FIG. 3 illustrates a lightweight structural element in the form of a housing part.

FIG. 3 illustrates a housing part 2 to illustrate, inter alia, how a solid section, in this case a flange 11, is integrated for attachment to adjacent parts. This is intended to be an axially symmetric housing part 2 for a gas turbine, where the figure corresponds to a partial axial section in the region of the flange. Shell 4 includes an outer and inner cover sheet 7 and 8, which are concentrically positioned at a constant radial distance A from each other. Core structure 10 is in a compressed state, is fixed in position by sintering, and is also sintered to cover sheets 7, 8. Solid metallic flange 11 extends into the lightweight structure, in order to provide a sufficient amount of surface for joining it to cover sheets 7, 8, using welding, soldering, bonding, etc.

Such housing parts may be configured to have multiple sections, i.e., to be segmented, in the circumferential direction.

The properties of lightweight structural elements according to the present invention may also be influenced by the degree of compression of the core structure prior to sintering.

What is claimed is:

1. A lightweight, composite structural element for a turbo engine, comprising:

a thin metallic shell delimiting the structural element on at least two sides opposite to one another and covering a large portion of a surface of the structural element; and a metallic core structure having a large proportion of empty space, the core structure including a cohesive structural element having at least one of a felt and mesh construction and including at least one of wires, strips and shavings, the core structure sintered together and sintered to the shell by surface welding;

wherein the shell and the core structure are rigidly joined to each other and are formed of one of a same metal and two metals having a same base.

2. The structural element according to claim 1, wherein the structural element is arranged in the form of a turbine blade of a gas turbine.

3. The structural element according to claim 1, wherein the shell and the core structure are formed of a metal having one of an aluminum base, a titanium base, an iron base, a nickel base and a cobalt base.

4. The structural element according to claim 1, wherein the structural element is arranged in the form of a blade for a turbo engine, the shell one of including two cover sheets joined in a region of a leading edge and a trailing edge of the blade and being made of a thin-walled hollow section.

5. A lightweight, composite structural element for a turbo engine, comprising:

a thin metallic shell delimiting the structural element on at least two sides opposite to one another and covering a large portion of a surface of the structural element; and a metallic core structure having a large proportion of empty space, the core structure including a cohesive structural element having at least one of a felt and mesh construction and including at least one of wires, strips and shavings, the core structure sintered together and sintered to the shell by surface welding;

wherein the shell and the core structure are rigidly joined to each other and are formed of one of a same metal and two metals having a same base; and wherein the core structure is integrally solidified and integrally joined to the shell by surface welding.

6. A lightweight, composite structural element for a turbo engine, comprising:

a thin metallic shell delimiting the structural element on at least two sides opposite to one another and covering a large portion of a surface of the structural element; and a metallic core structure having a large proportion of empty space, the core structure including a cohesive structural element having at least one of a felt and mesh construction and including at least one of wires, strips and shavings, the core structure sintered together and sintered to the shell by surface welding;

wherein the shell and the core structure are rigidly joined to each other and are formed of one of a same metal and two metals having a same base; and wherein the core structure in a finished structural element is arranged in a shape formed by compression of a volumetrically larger blank into the shape.

7. A lightweight, composite structural element for a turbo engine, comprising:

a thin metallic shell delimiting the structural element on at least two sides opposite to one another and covering a large portion of a surface of the structural element; and a metallic core structure having a large proportion of empty space, the core structure including a cohesive structural element having at least one of a felt and mesh construction and including at least one of wires, strips and shavings, the core structure sintered together and sintered to the shell by surface welding;

wherein the shell and the core structure are rigidly joined to each other and are formed of one of a same metal and two metals having a same base, and wherein the structural element is arranged in the form of a housing part of a turbine engine, the shell including at least one of two diametrically opposed planar and curved cover sheets having a constant spacing in at least some regions.

8. A lightweight, composite structural element for a turbo engine, comprising:

a thin metallic shell delimiting the structural element on at least two sides opposite to one another and covering a large portion of a surface of the structural element; and a metallic core structure having a large proportion of empty space, the core structure including a cohesive structural element having a felt-like mesh construction and including at least one of wires, strips and shavings, the core structure sintered together and sintered to the shell by surface welding;

wherein internal friction caused by mutual contact of the at least one of wires, strips and shavings in the core structure provides an elevated degree of inherent damping to the structural element.

* * * * *